US006641422B2

(12) United States Patent
Duggan et al.

(10) Patent No.: US 6,641,422 B2
(45) Date of Patent: Nov. 4, 2003

(54) HIGH INTENSITY DISCHARGE LAMP AND A METHOD OF INTERCONNECTING A HIGH INTENSITY DISCHARGE LAMP

(75) Inventors: Thomas A. Duggan, Springfield, OH (US); Richard R. Kemp, Urbana, OH (US); Nam H. Vo, Marysville, OH (US)

(73) Assignee: Honeywell International Inc., Morristown, NJ (US)

( * ) Notice: Subject to any disclaimer, the term of this patent is extended or adjusted under 35 U.S.C. 154(b) by 405 days.

(21) Appl. No.: 09/731,134

(22) Filed: Dec. 6, 2000

(65) Prior Publication Data

US 2002/0067116 A1 Jun. 6, 2002

(51) Int. Cl.[7] ..... H01R 13/52

(52) U.S. Cl. ..... 439/278; 439/281; 439/280; 439/602; 439/611; 313/49; 313/51

(58) Field of Search ..... 439/278, 281, 439/732, 280, 230, 220, 336, 356, 602, 611, 613, 615, 699.2, 282, 350, 558, 559; 313/49, 51

(56) References Cited

U.S. PATENT DOCUMENTS

| | | | | |
|---|---|---|---|---|
| 2,627,536 A | | 2/1953 | Elliott | |
| 3,003,058 A | | 10/1961 | Babcock | 240/41.35 |
| 3,434,097 A | | 3/1969 | Hudson et al. | |
| 3,678,432 A | * | 7/1972 | Boliver | 337/201 |
| 3,785,020 A | * | 1/1974 | Boros | 313/315 |
| 4,084,112 A | | 4/1978 | Hebert et al. | |
| 4,533,851 A | | 8/1985 | Block et al. | 313/51 |
| 4,631,651 A | | 12/1986 | Bergin et al. | 362/267 |
| 4,724,353 A | | 2/1988 | Devir | 313/318 |
| 4,728,849 A | | 3/1988 | Morris et al. | 313/113 |
| 4,764,854 A | * | 8/1988 | Matsune et al. | 362/226 |
| 4,807,099 A | | 2/1989 | Zelin | 362/225 |
| 4,950,942 A | | 8/1990 | Braun et al. | 313/318 |
| 5,016,150 A | | 5/1991 | Gordin et al. | 362/263 |
| 5,079,474 A | | 1/1992 | Holten | 313/113 |
| 5,128,589 A | | 7/1992 | Dakin | 313/634 |
| 5,177,396 A | | 1/1993 | Gielen et al. | 313/113 |
| 5,206,799 A | | 4/1993 | Tiesler | 362/296 |
| 5,216,318 A | * | 6/1993 | Van Dulmen et al. | 313/49 |
| 5,227,690 A | * | 7/1993 | Van Gennip | 313/318.09 |
| 5,235,498 A | | 8/1993 | Van Dulmen et al. | 362/296 |
| 5,254,901 A | | 10/1993 | Haraden et al. | 313/113 |
| 5,263,881 A | | 11/1993 | Henrici et al. | 439/686 |
| 5,428,261 A | | 6/1995 | Wittig et al. | |
| 5,518,425 A | | 5/1996 | Tsai | 439/696 |
| 5,568,008 A | | 10/1996 | Narita | 313/113 |
| 5,651,608 A | | 7/1997 | Wedell | 362/267 |
| 5,871,377 A | | 2/1999 | Sato et al. | 439/675 |

FOREIGN PATENT DOCUMENTS

| | | |
|---|---|---|
| DE | 964 792 C | 5/1957 |
| DE | 21 04 253 A | 8/1972 |
| EP | 0 443 964 A1 | 8/1991 |
| JP | 09-180680 A | 7/1997 |
| JP | 11-144511 A | 5/1999 |
| WO | WO 01/39237 A1 | 5/2001 |

* cited by examiner

*Primary Examiner*—Tho D. Ta
(74) *Attorney, Agent, or Firm*—Larry J. Palguta

(57) ABSTRACT

A high intensity discharge lamp (HID) (200) includes an electrically powered lamp (200) having a lamp exterior (220) and at least one lead (226) extending outside of the lamp. An electrical interface (202) includes a male connector (204) fastened at its base (302) to one of the leads (226), an insulate housing (206) having an inner contour (402) shaped to fittedly encompass therein the male connector and at least a portion of the lead, and a cement contact (208) that fastens the housing to the lamp exterior without air gaps. A boot (212) hermetically seals the insulate housing. A female connector (210) is mated to the male connector within the boot, and a feed line (501) having an insulating cover (502) is electrically connected at one end to the female connector and to a power source at the other end.

38 Claims, 6 Drawing Sheets

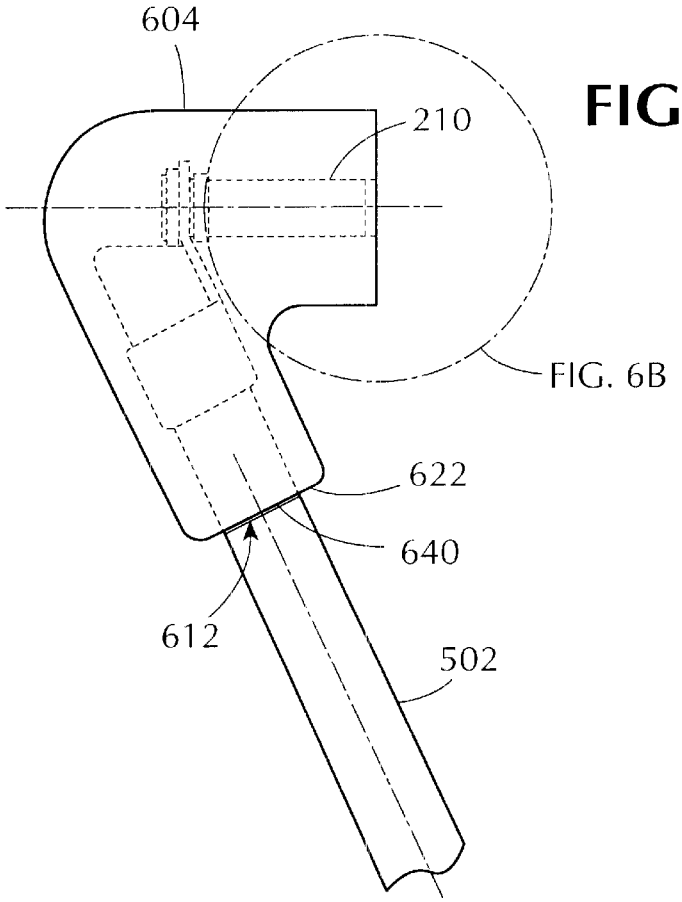
FIG. 6A
FIG. 6B
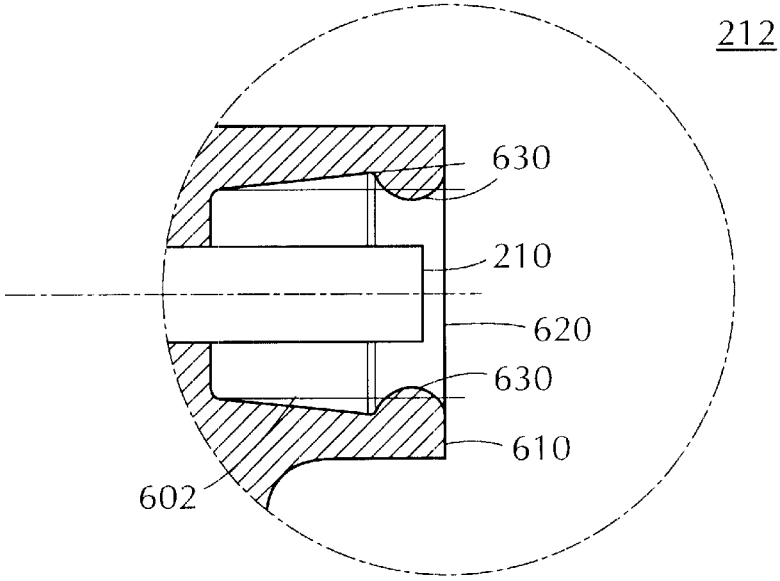

HIGH INTENSITY DISCHARGE LAMP AND A METHOD OF INTERCONNECTING A HIGH INTENSITY DISCHARGE LAMP

BACKGROUND OF THE INVENTION

1. Field of the Invention

The present invention is directed generally to a method and apparatus for providing high intensity light and, more particularly, to a high intensity discharge lamp and a method of interconnecting a high intensity discharge lamp.

2. Description of the Background

A high intensity discharge (HID) system is a lighting system which throws an intense light therefrom. High intensity discharge systems are generally used in commercial and military aircraft applications.

A conventional high intensity discharge lamp is illustrated in FIG. 1. The high intensity discharge lighting system generally includes a lamp 10. The lamp 10 is preferably hermetically sealed, and may include two electrodes 12 within the hermetically sealed cavity 14. An HID lighting system preferably uses a high voltage to strike an arc between the electrode 12, thus providing a bright light from the lamp. The electrodes 12, or other light source, is preferably connected to and supported within the lamp 10 by a support tree 18.

The current used to provide the light to the HID lamp light source 12 flows from a power source exterior to the lamp 10, and generally enters the lamp 10 via two small interconnects 20, preferably of copper, at the back of the lamp 10. The two interconnects 20 at the back of the lamp 10 have generally constituted an exposed un-insulated surface at the back of the lamp 10 to which the power source leads 22 are connected, such as by screwing the power source to mated threads on the exposed interconnect 20.

Unfortunately, HID lamps currently in use do not always provide a secure connection between the power supply source leads 22 and the interconnects 20, and, additionally, do not always provide insulation adequate to enclose the connection between the power source leads 22 and the interconnects 20. When the interconnects and power supply are not securely connected, such as by aircraft maintenance personnel, or when the connection between the interconnects and the leads is not adequately insulated, arcing can occur due to the high voltage in use in HID aircraft application. This arcing problem can be exacerbated by the high altitudes at which HID lamps are required to perform.

Arcing problems on an aircraft may lead to devastating consequences. Arcing can start fires, and, because HID lamps are often in use in areas of an aircraft where fuel or fuel vapors are present, such as on the wings, fires caused by arcing can lead to explosions or serious malfunctions on the aircraft. Such explosions and malfunctions can lead to the destruction of an aircraft and, consequently, a loss of life. Additionally, arcing can negatively effect the performance of nearby equipment on the aircraft, and cause power outages to vital systems, as well as overloads to vital systems.

Furthermore, the present manner of interconnecting the power source to the HID interconnects, such as by screwing or welding, is cumbersome and difficult for aircraft personnel. The difficulty encountered in this interconnection can lead to the connection not being made properly or completely. This lack of a proper or complete connection can lead to arcing problems. Additionally, the difficulty in properly connecting the power source and the interconnects can lead to difficulty in the replacement or substitution of HID lamps, or the avoidance of such replacements by aircraft personnel, when such replacements would be otherwise necessary.

Thus, there currently exists a need for an HID lamp, an HID lamp interconnect, and a method of making an HID lamp, that will prevent arcing difficulties on aircraft, as well as simplify the replacement of, and substitution of, HID lamps.

BRIEF SUMMARY OF THE INVENTION

The present invention is directed to a high intensity discharge lamp. The high intensity discharge lamp of the present invention includes an electrically powered lamp having a lamp exterior and at least one lead extending outside of the lamp, a male connector that is fastened at its base to one of the leads of the lamp, an insulate housing having an inner contour shaped to fittedly encompass therein the male connector and at least a portion of the lead of the arc lamp, and a cement contact that fastens, without air gaps, the housing to the lamp exterior. The lamp may additionally include a boot that hermetically locks over the insulate housing, a female connector mated to the male connector within the boot, and a feed line electrically connected to the female connector on one end and to a power source at the other end.

Furthermore, the present invention includes an electrical interface for use with an electrically powered lamp having a lamp exterior and at least one lead extending outside of the lamp. The electrical interface includes a male connector that is fastened at its base to one of the leads of the lamp, an insulate housing having an inner contour shaped to fittedly encompass therein the male connector and at least a portion of the lead of the arc lamp, and a cement contact that fastens, without air gaps, the housing to the lamp exterior.

The present invention also includes a method of interconnecting a high intensity discharge lamp. The method includes providing an electrically powered lamp having a lamp exterior and at least one lead extending outside of the lamp, fastening a male connector, at a base of the male connector, to one of the leads of the lamp, sliding an insulate housing fittedly over the male connector and at least a portion of the lead of the lamp, and hermetically fastening the insulate housing to the lamp exterior. The method of the present invention may additionally include detachably hermetically locking a boot over the insulate housing, wherein the boot includes therein a female connector mated to the male connector, mating the female connector to the male connector, electrically connecting a feed line to the female connector, which feed line passes electrical current, and permanently hermetically sealing the feed line to the boot.

The present invention solves problems experienced with the prior art because it prevents arcing difficulties on aircraft, particularly at above 25 kV operating voltage for a high intensity discharge lamp, and above 25,000 feet altitude for aircraft, as well as simplifying the replacement of, and substitution of, HID lamps. Those and other advantages and benefits of the present invention will become apparent from the detailed description of the invention hereinbelow.

BRIEF DESCRIPTION OF THE SEVERAL VIEWS OF THE DRAWING

For the present invention to be clearly understood and readily practiced, the present invention will be described in conjunction with the following figures, wherein:

FIG. 6 is a schematic diagram illustrating a boot for use in the electrical interface.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical high voltage system and method. Those of ordinary skill in the art will recognize that other elements are desirable and/or required in order to implement the present invention. However, because such elements are well known in the art, and because they do not facilitate a better understanding of the present invention, a discussion of such elements is not provided herein. Additionally, those of ordinary skill in the art will recognize that, although the present invention is described hereinbelow with respect to a lighting system, the present invention may be implemented using any high voltage device having exposed electrical leads.

Figure 1:
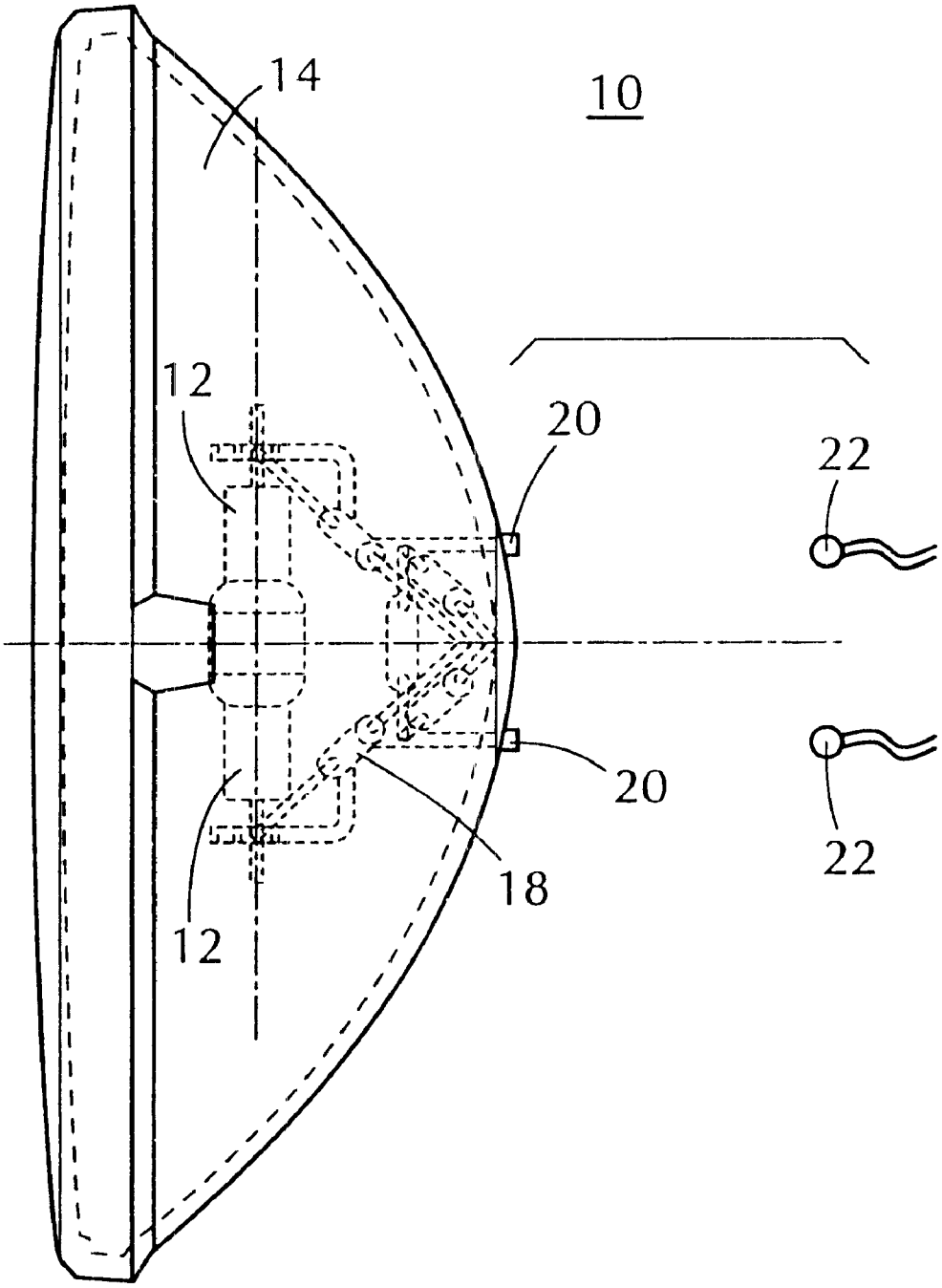
FIG. 1 BACKGROUND ART
FIG. 1 is a schematic diagram illustrating a high intensity discharge lamp.
Figure 2A:
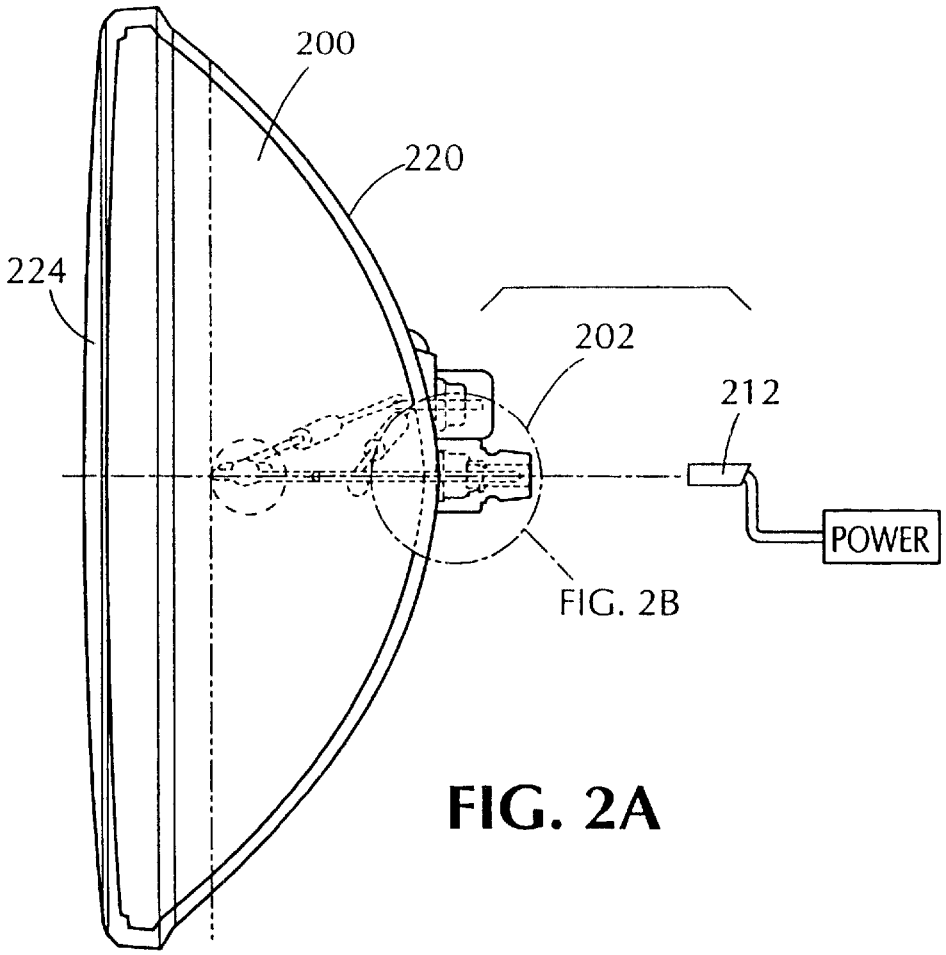
FIGS. 2A and 2B are schematic diagrams illustrating a high intensity discharge lamp having an electrical interface connected thereto.

FIG. 2A is a schematic diagram illustrating a high intensity discharge lamp 200 developed in accordance with the present invention and having an electrical 202 connected thereto. The electrical interface 202, as shown in detail 2B, includes a male connector 204, an insulate housing 206, and at least one cement contact 208. Tn a preferred embodiment of the present invention, one electrical interface 202 is connected to each of the two electrical leads 226 extending through the back of the lamp 200, which leads are, for example, electrical current carrying, such as copper, components that are heated and pressed into the glass of the lamp 200, thereby creating a hermetic seal. Additionally, the electrical interface 202 preferably includes a female connector 210 (see FIGS. 6A and 6B) within a boot 212, which female connector 210 electrically contacts the male connector 204.

The HID lamp 200 preferably is an electrical arc lamp, but may be any high voltage lamp or device. The HID lamp 200 includes a lamp exterior 220, and hermetically sealed within the lamp exterior 220 are two electrodes. A portion 224 of the lamp exterior 220 is preferably transparent or frosted, to allow light generated at the electrodes to pass to the outside environment from the lamp exterior 220. The two electrodes each have a lead 226 connected thereto. The leads 226 pass through the lamp exterior 220, and are hermetically sealed as the leads 226 pass therethrough. The leads 226 extend outward into the outside environment from the point at which the leads 226 pass through the lamp exterior 220.

Figure 3A:
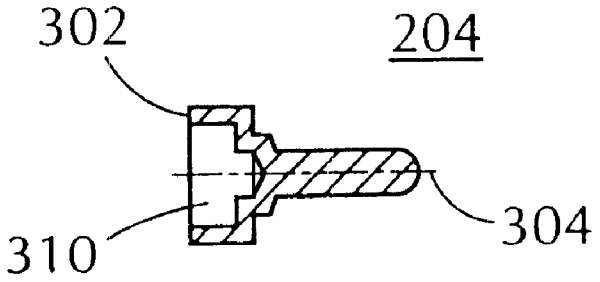
FIGS. 3A and 3B are schematic diagrams illustrating a male connector.
Figure 3B:
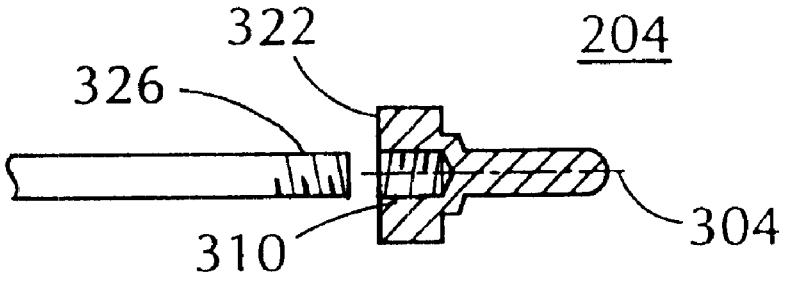

FIGS. 3A and 3B are schematic diagrams illustrating the male connector 204 of FIG. 2A. The male connector 204 is of the type known in the art, such as a metallic extension, stud, or pin, and may be of any metallic or alloyed substance capable of withstanding high current passing therethrough. The male connector 204 has a base 302 at the point of contact with the lamp exterior 220, and extends to an end 304 at the point of the male connector 204 opposite the lamp exterior 220. The male connector 204 is fastened to at least one of the leads 226 of the lamp 200, and extends outwardly from the exterior 220 of the lamp 200. Thus, the male connector preferably includes a placement opening 310, into which the leads 226 may be placed. In a preferred embodiment, one male connector 204 is connected to each lead 226 of the lamp 200.

The fastening of the male connector 204 to the lead 226 must form an electrical bond that allows current to pass to/from the male connector 204 from/to the lead 226. For example, the at least one lead 226 may include first screw threads 326 thereon, and the first screw threads 326 are then preferably mated to second screw threads 322 on the base of said male connector 204. The male connector 204 is then fastened to the lead 226 by an interlocking of the first screw threads 326 and the second screw threads 322. In a second preferred embodiment, the male connector 204 is fastened to the lead 226 by a weld, such as a spot weld. In an additional preferred embodiment, the male connector 204 may be fastened to the lead 226 by a solder capable of operating under the operating conditions of an HID 200. In each preferred embodiment, the fastening of the male connector 204 to the lead 226 provides a hermetic seal therebetween.

Figure 2B:
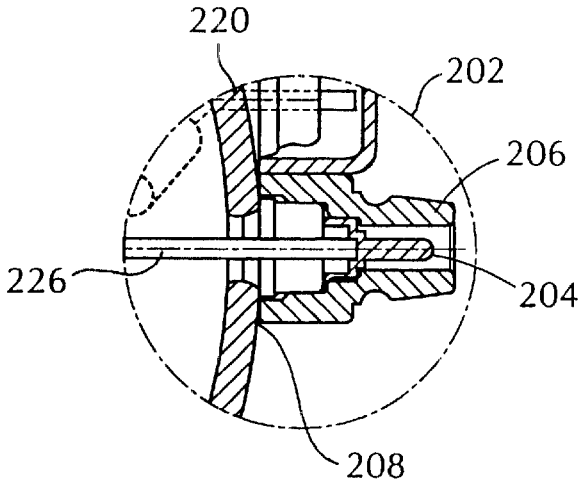
Figure 4:
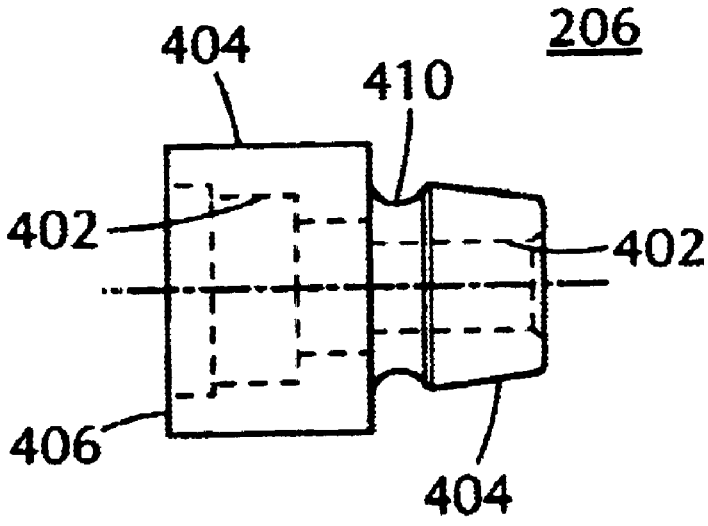
FIG. 4 is a schematic diagram illustrating an insulate housing.

FIG. 4 is a schematic diagram illustrating the insulate housing 206 of FIG. 2. The insulate housing 206 is an insulator to prevent arcing at the connection point of the male connector 204 to a female connector 210, and at the connection point of the male connector 204 to the lead 226. Thus, the male connector 204 is preferably sealed hermetically within the insulate housing 206, by sealing methods apparent to those skilled in the art.

In a preferred embodiment, the insulate housing 206 extends outwardly from the lamp exterior 220 a second distance, and the second distance is greater than the first distance by which the male connector 204 extends outwardly from the lamp exterior 220. The insulate housing 206 has an inner contour 402 along its inner surface where the inner contour 402 is shaped to fittedly encompass therein the male connector 204 and at least a portion of the lead 226 of the lamp 200.

Further, the inner contour 402 is preferably shaped to provide a snug fit for a female connector 210 to be placed with the insulate housing 206 to mate with the male connector 204. The insulate housing 206 has an outer contour 404, and at least the portion 406 of the outer contour 404 that is immediately proximate to the lamp exterior 220 is shaped to contour to the lamp exterior 220 immediately surrounding the lead 226 to which the male connector 204 is fastened.

In addition, the outer contour 404 is preferably shaped to include an air-tight integral locking groove 410 for locking with the interior surface of a boot 212, as discussed hereinbelow, and this integral locking groove 410 may be at an end of the housing 206 opposite the lamp exterior 220. In a preferred embodiment, the insulate housing 206 is formed of ceramic, and may be formed of additional materials capable of withstanding high current flow, and the heat that corresponds thereto, such as glass or plastics.

Returning now to FIG. 2, the at least one cement contact 208 fastens, without any air gaps, the outer contour 404 of the insulate housing 206 immediately proximate to the lamp exterior 220. The at least one cement contact 208 is a type of cement capable of operating under the conditions of the present application, and is capable of bonding the insulate housing 206 to the glass of the lamp exterior 220. The contact 208 may be, for example, a rubber cement that seals upon placement.

The cement contact 208 may be placed after the male connector 204 is fastened, or, in an embodiment wherein the male connector 204 and insulate housing 206 are prefabricated, the cement contact 208 may be integrally placed on the outer contour 404 of the insulate housing 206, and may seal as it is contacted with the lamp exterior 220, such as when the male connector 204 is seated, such as by screwing to the lead 226. The cement contact 208 may then be unsealed when the male connector 204 is unscrewed, for example, for ease of part replacements. In a second preferred embodiment, the cement contact 208 may be permanent upon placement.

In a preferred embodiment, the cement contact 208 is rated to prevent arcing of at least 20 kV passing through the lead 226 from/to the male connector 204 base. Additionally, the cement contact 208 is rated to prevent arcing at high altitudes, such as at least 25,000 feet. In a more preferred embodiment, the cement contact 208 is rated to prevent arcing of at least 25 kV at an altitude of at least 40,000 feet, and, in a most preferred embodiment, the cement contact 208 is rated to prevent arcing of at least 30 kV at an altitude of at least 50,000 feet.

Figure 5:
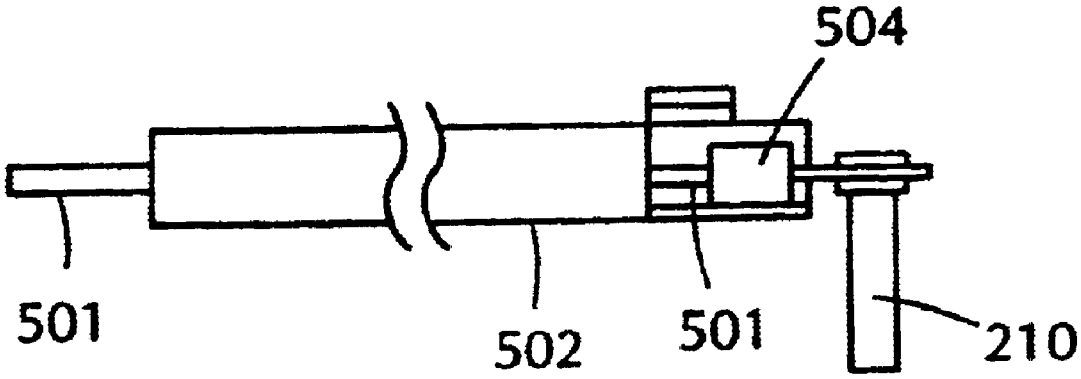
FIG. 5 is a schematic diagram illustrating a female connector for use in the electrical interface.

FIG. 5 is a schematic diagram illustrating a female connector 210 for use in the electrical interface 202 of FIG. 2. FIG. 6 is a schematic diagram illustrating a boot 212 for use in the electrical interface 202 of FIG. 2 with the female connector 210 of FIG. 5.

Referring to FIGS. 5 and 6, the boot 212 is preferably formed of silicon rubber, although other materials known to those skilled in the art may be used, subject to the condition that those other materials are preferably elastic, and must be capable of properly insulating in high voltage applications. The boot 212 has an inner boot contour 602 and an outer boot contour 604. The inner boot contour 602 detachably locks over the outer contour 404 of the insulate housing 206, which outer contour 404 of the insulate housing 206 may include an integral locking groove 410, as discussed hereinabove.

The boot 212 has two ends 610, 612, and each end 610, 612 includes an opening 620, 622 passing therethrough. The opening 620 of one of the boot ends 610 preferably integrally includes an elastic lip 630 along the inner boot contour 602, which elastic lip 630 creates a hermetic lock by sealing over the integral locking groove 410 on the outer contour 404 of the insulate housing 206 opposite the lamp exterior 220. The elastic lip 630 is preferably formed of silicon rubber.

The female connector 210 is mounted within the boot 212 and between the two openings of the boot 212. The female connector 210 is mated to the male connector 204. A feed line 501 is electrically connected to the female connector 210 through an insulating covering 502, and serves to pass electrical current therethrough. A metal structure 504, preferably having two open ends, is provided within the insulating covering 502, and the female connector 210 is crimped and/or soldered into the metal structure 504 on one open end of the metal structure. The feed line 501 is crimped and/or soldered at the other open end of the metal structure 504, and the feed line 501 is electrically connected, through the metal structure 504, to the female connector 210. The metal structure 504 is preferably mounted within the insulation covering 502, centered within the insulation covering 502, and having a center axis passing between the two open ends of the metal structure 504 approximately parallel to the tangential axis along the exterior of the insulation covering 502. Thus, the feed line 501, insulation covering 502 containing the metal structure 504, and the female connector 210 form a wire assembly.

The feed line 501, insulation covering 502 containing the metal structure 504, and the female connector 210 are permanently hermetically sealed 640 to the boot 212, by, for example, injection molding of the silicon boot 212 around the feed line 501, insulation covering 502 containing the metal structure 504, and the female connector 210, and this wire assembly extends from one end 612 of the boot 212 and passes through the inner boot contour 602. The female connector 210 extends to the end 610 of the boot 212 opposite the end 612 from which the feed line 502 extends, and passes through the inner boot contour. The permanent hermetic seal 640 of the boot 212 to the feed line 502 may be formed, for example, through the injection molding, or by a vulcanization. In the preferred embodiment, both the feed line 502 and the boot 212 are formed of silicon rubber, and the hermetic seal 640 between the feed line 502 and the boot 212 is a silicon rubber to silicon rubber bond that requires no adhesive.

The electrical interface 202 of the present invention allows the HID lamp 200 to be activated at high altitudes, such as at 55,000 feet, without arcing. Further, the electrical interface 202 of the present invention, due to the provision of after-lamp-production installation of the male connector 204 and housing 206, and due to the ease of detachment of the boot 212, and security of attachment provided by the boot 212, provides improved substitution and replacement of HID lamps.

Figure 7:
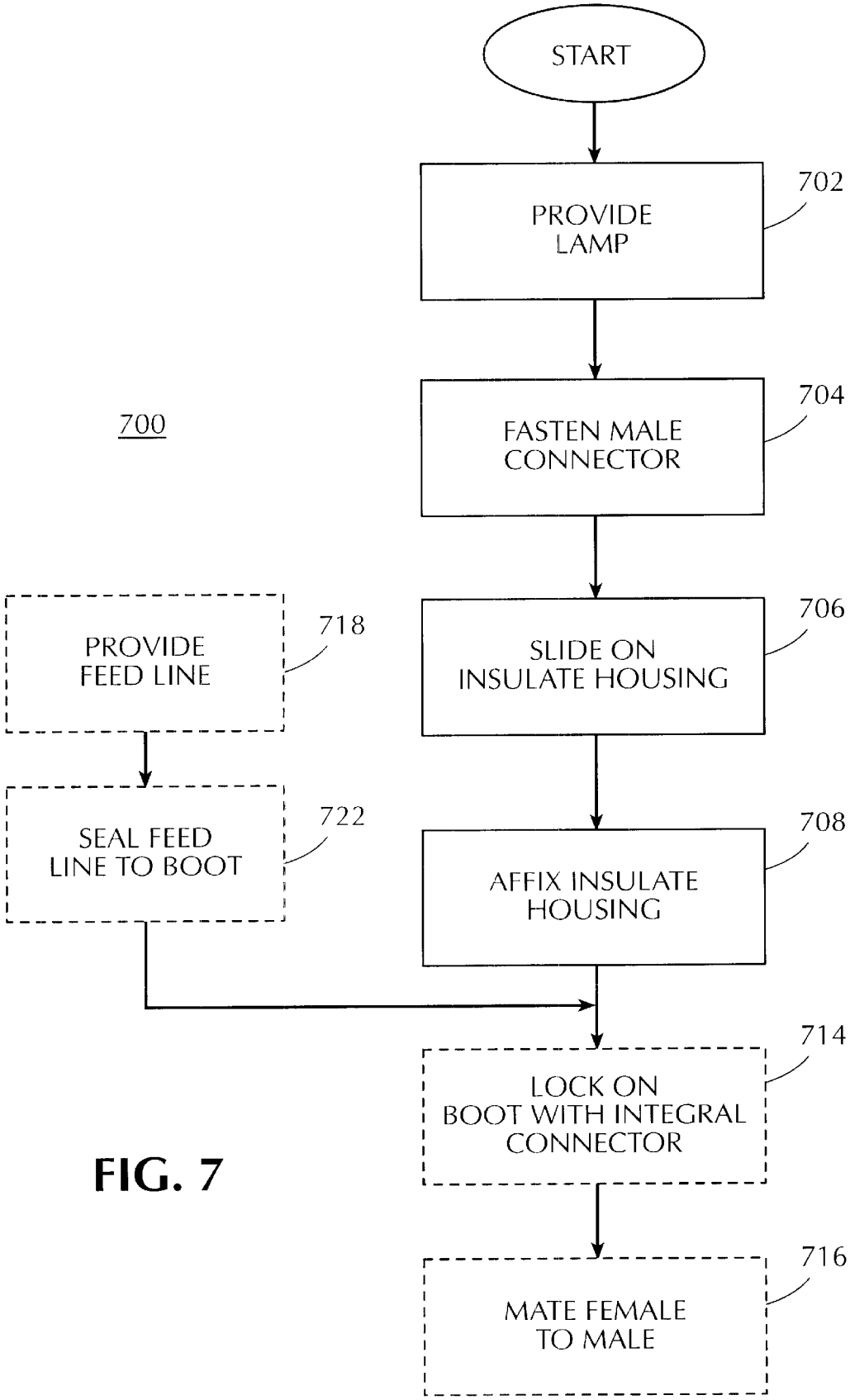
FIG. 7 is a flow diagram illustrating a method of interconnecting a high intensity discharge lamp.

FIG. 7 is a flow diagram illustrating a method 700 of interconnecting a high intensity discharge lamp 200. The method includes the step 702 of providing an electrically powered lamp 200 having a lamp exterior 220 and at least one lead 226 extending outside of the lamp 200, the step 704 of fastening a male connector 204, at a base of the male connector 204, to one of the at least one leads 226 of the lamp 200, the step 706 of sliding an insulate housing 206 fittedly over the male connector 204 and at least a portion of the lead 226 of the lamp 200, and the step 708 of hermetically fastening the insulate housing 206 to the lamp exterior 220.

The method 700 may additionally include the step 714 of detachably hermetically locking a boot 212 over the insulate housing 206, wherein the boot 212 includes therein a female connector 210 mated to the male connector 204, the step 716 of mating the female connector 210 to the male connector 204 by the detachable hermetically locking 714, the step 718 of electrically connecting a feed line to the female connector, which feed line passes electrical current, and/or the step 722 of permanently hermetically sealing the feed line to the boot 212.

Those of ordinary skill in the art will recognize that many modifications and variations of the present invention may be implemented. For example, the electrical connector set forth herein is applicable to different types of high voltage connection applications, and not just to HID lamps. The foregoing description and the following claims are intended to cover all such modifications and variations.

What is claimed is:

1. An electrical interface for use with an electrically powered lamp having a lamp exterior and at least one lead extending outside of the lamp exterior, said interface comprising:

a male connector having a base, said male connector being fastened at said base, said at least one lead extending outside of the lamp exterior to extend said male connector outwardly from the lamp exterior; and an insulate housing having an inner contour and an outer contour, said inner contour of said insulate housing being shaped to fittedly encompass said extended male connector and the fastened at least one lead extending outside of the lamp exterior, and at least a portion of the outer contour being shaped to contour to the lamp exterior immediately surrounding the at least one lead to form a cement contact, without air gaps, to the lamp exterior.

2. The electrical interface of claim 1, wherein said insulate housing extends outwardly from the lamp exterior a second distance greater than a first distance extended by said male connector outwardly from the lamp exterior.

3. The electrical interface of claim 1, wherein the at least one lead includes a plurality of first screw threads, said first screw threads being mated to a plurality of second screw threads at the base of said male connector, and said male connector being fastened to the at least one lead by interlocking the first screw threads and the second screw threads.

4. The electrical interface of claim 1, wherein said male connector is fastened to the lead by an electrical bond.

5. The electrical interface of claim 1, wherein said male connector is fastened to the lead by a solder.

6. The electrical interface of claim 1, wherein said insulate housing is a ceramic.

7. The electrical interface of claim 1, wherein said insulate housing is a glass.

8. The electrical interface of claim 1, wherein the base of said male connector is sealed from air gaps within said insulate housing.

9. The electrical interface of claim 1, wherein said insulate housing includes an integral lock at an end of the outer contour opposite the lamp exterior.

10. The electrical interface of claim 1, wherein said formed cement contact being rated to prevent arcing when electrical potential is applied to the electrical interface of at least 20 kV.

11. The electrical interface of claim 1, wherein said male connector is fastened to the lead by a weld.

12. The electrical interface of claim 11, wherein the weld is a spot weld.

13. The electrical interface of claim 1, wherein said formed cement contact being rated to prevent arcing when electrical potential is applied to the electrical interface at at least 25,000 feet.

14. The electrical interface of claim 13, wherein said formed cement contact being rated to prevent arcing when electrical potential is applied to the electrical interface of at least 25 KV.

15. The electrical interface of claim 14, wherein said formed cement contact being rated to prevent arcing when electrical potential is applied to the electrical interface at at least 40,000 feet.

16. The electrical interface of claim 15, wherein said formed cement contact being rated to prevent arcing when electrical potential is applied to the electrical interface of 30 kV at 55,000 feet.

17. The electrical interface of claim 1, further comprising a boot having an inner boot contour and an outer boot contour, wherein the inner boot contour detachably hermetically locks over the outer contour of said insulate housing.

18. The electrical interface of claim 17, wherein the boot comprises silicon rubber.

19. The electrical interface of claim 17, wherein said boot has two ends, and wherein each end includes an opening, and wherein the opening of one end includes an elastic lip on the inner boot contour, and said elastic lip creates the hermetic lock by sealing into a groove on the outer contour of said insulate housing opposite the lamp exterior.

20. The electrical interface of claim 19, wherein the elastic lip comprises silicon rubber.

21. The electrical interface of claim 17, further comprising:

a female connector mated to said male connector; and a feed line electrically connected to said female connector, and said feed line passes electrical current.

22. The electrical interface of claim 21, wherein said feed line is permanently and hermetically sealed to said boot, and wherein said feed line extends from one end of said boot and passes through the inner boot contour, and wherein said female connector extends to the opposite end of said boot and passes through the inner boot contour.

23. The electrical interface of claim 22, wherein the permanent hermetic seal of said boot to said feed line comprises a vulcanization.

24. An electrical interface for use with an electrically powered lamp, said lamp having a lamp exterior and at least one lead extending outside of the lamp exterior, said interface comprising:

a male connector having a base, said male connector being fastened at said base to said at least one lead extending outside of the lamp exterior to extend said male connector outwardly from the lamp exterior;

means for insulating said male connector, said insulating means being shaped to fittedly encompass said positioned male connector and the fastened at least one lead of the lamp, and said insulating means being contoured to the lamp exterior immediately surrounding the at least one lead; and means for securely fastening, without air gaps, said insulating means to the lamp exterior.

25. A high intensity discharge lamp, comprising:

an electrically, powered lamp having a lamp exterior and at least one lead extending outside of the lamp;

a male connector having a base, said male connector being fastened at said base to said at least one lead extending outside of the lamp exterior to extend said male connector outwardly from the lamp exterior;

an insulate housing having an inner contour and an outer contour, said inner contour of said insulate housing being shaped to fittedly encompass said extending male connector and the fastened at least one lead extending outside of the lamp exterior, and at least a portion of the outer contour being shaped to contour to the lamp exterior immediately surrounding the at least one lead to form a cemented contact, without air gaps, to the lamp exterior.

26. The high intensity discharge lamp of claim 25, wherein the at least one lead includes a plurality of first screw threads, which first screw threads are mated to a plurality of second screw threads at the base of said male connector, and wherein said male connector is fastened to the lead by an interlocking of the first screw threads and the second screw threads.

27. The high intensity discharge lamp of claim 25, wherein said insulate housing is a ceramic.

28. The high intensity discharge lamp of claim 25, wherein said insulate housing is a glass.

29. The high intensity discharge lamp of claim 25, wherein said cement contact is rated to prevent arcing of at least 20 kV at at least 25,000 feet.

30. The high intensity discharge lamp of claim 25, further comprising a boot having an inner boot contour and an outer boot contour, wherein the inner boot contour detachably hermetically locks over the outer contour of said insulate housing.

31. The high intensity discharge lamp of claim 30, wherein the boot comprises silicon rubber.

32. The high intensity discharge lamp of claim 30, further comprising:

a female connector mated to said male connector; and a feed line electrically connected to said female connector, which feed line passes electrical current.

33. The high intensity discharge lamp of claim 32, wherein said feed line is permanently and hermetically sealed to said boot, and wherein said feed line extends from one end of said boot and passes through the inner boot contour, and wherein said female connector extends to the opposite end of said boot and passes through the inner boot contour.

34. A method of interconnecting a high intensity discharge lamp, comprising the steps of:

providing an electrically powered lamp, said lamp having a lamp exterior;

extending outside of the lamp exterior at least one lead of said lamp;

fastening a male connector with a base to the at least one lead extending outside of the lamp exterior;

sliding an insulate housing fittedly over the male connector, said insulate housing having an inner contour and an outer contour;

shaping said inner contour of said insulate housing to fittedly encompass said male connector and the fastened at least one lead extending outside of the lamp exterior; and hermetically fastening the insulate housing to the lamp exterior without air gaps.

35. The method of claim 34, wherein said step of fastening the male connector to the at least one lead comprises the step of:

screwing the male connector onto the at least one lead.

36. The method of claim 34, further comprising the step of:

detachably hermetically locking a boot over the insulate housing, wherein the boot includes therein a female connector for mating to the male connector;

mating the female connector to the male connector by said detachable hermetically locking; and electrically connecting a feed line to the female connector, wherein said feed line passes electrical current.

37. The method of claim 36, further comprising the step of:

permanently hermetically sealing the feed line to the boot.

38. An electrical interface for use in high voltage applications, comprising:

an electrical device having a device exterior;

at least one lead connected to said electrical device extending outside of the device exterior;

a male connector having a base, said male connector being fastened at said base to said at least one lead extending outside of the device exterior to extend said male connector outwardly from of said device; and an insulate housing having an inner contour and an outer contour, said inner contour of said insulate housing being shaped to fittedly encompass said extended male connector and the fastened at least one lead of the electric device extending outside of the device exterior, and at least a portion of the outer contour being shaped to contour to the device exterior immediately surrounding the at least one lead to form a cement contact, without air gaps, to the device exterior.

* * * * *